United States Patent [19]

Shelton

[11] Patent Number: 4,466,572

[45] Date of Patent: Aug. 21, 1984

[54] FLUID-JETTING APPARATUS

[75] Inventor: Robert Q. Shelton, Duncan, Okla.

[73] Assignee: Halliburton Company, Duncan, Okla.

[21] Appl. No.: 413,022

[22] Filed: Aug. 30, 1982

[51] Int. Cl.[3] ..... B05B 3/18

[52] U.S. Cl. ..... 239/186; 104/165

[58] Field of Search ..... 239/184, 185, 186, 70; 104/165; 105/32; 254/37, 106

[56] References Cited

U.S. PATENT DOCUMENTS

| | | | |
|---|---|---|---|
| 3,985,161 | 10/1976 | Nelson | 239/186 X |
| 4,041,899 | 8/1977 | Wolfe et al. | 239/186 |
| 4,256,511 | 3/1981 | Atchison et al. | 239/186 X |

*Primary Examiner*—John J. Love
*Assistant Examiner*—Mary F. McCarthy
*Attorney, Agent, or Firm*—E. Harrison Gilbert, III; James R. Duzan; Thomas R. Weaver

[57] ABSTRACT

A fluid-jetting apparatus includes a carriage member and an actuator member which are movable relative to each other depending upon the setting of respective brakes associated with the carriage member and actuator member and the actuation of a cylinder mounted on the carriage member having a piston rod extending therefrom and being connected to the actuator member. The movement of the carriage member and the actuator member is remotely controlled by a control mechanism including a dual timer and valve circuit contained in a housing. The control mechanism causes the carriage member and the actuator member to be alternately moved in increments along a support member on which the carriage member and the actuator member are mountable. The traversing of the support member can be in either direction.

15 Claims, 11 Drawing Figures

FLUID-JETTING APPARATUS

This invention relates generally to fluid-jetting apparatus movable along a support member in preselected increments and more particularly, but not by way of limitation, to electrically controlled, pneumatically powered fluid-jetting apparatus for cleaning regenerative air heaters.

Regenerative air heaters are utilized in power plants to extract waste heat from exhaust gases for reuse in the heat cycle. By alternately passing the heated exhaust gas across a wheel made up of numerous thin steel plates and then passing combustion air across the same steel plates which have been heated by the exhaust gas, the otherwise wasted heat is transferred from the heated steel plates to the combustion air.

A regenerative air heater wheel is generally of a large size, such as forty feet in diameter and seven feet in depth. I am also aware of such wheels which have diameters up to seventy feet and depths up to nine feet. In one embodiment the wheel is mounted so that it rotates and the air manifold is stationary; in a second embodiment the wheel is mounted so that it is stationary and the manifold rotates around the wheel.

During the operation of a regenerative air heater, a residue (such as of ash or silica) is deposited on the steel plates due to contaminants in the exhaust gas. This residue reduces the heat transfer coefficient of the steel plates and also restricts the flow of the exhaust gas through the heater thereby reducing the efficiency of the heater. As the residue deposit increases, the efficiency can be sufficiently reduced that it becomes necessary to clean the steel plates.

Depending upon the type of fuel which is used with the regenerative air heater, the cleaning process is either relatively easy or relatively difficult. If natural gas or oil is used as the fuel, the residue accumulates relatively slowly and cleaning can be accomplished relatively easily by use of a water jet. However, with the present trend of converting natural gas and oil heaters to coal heaters, the residues in coal heaters accumulate quicker and more substantially. As lower grades of coal, such as lignite, are used, this residue-accumulation problem becomes even worse.

It is known that to clean a regenerative air heater wheel, a fluid-jetting head can be movably associated with a beam which is mounted adjacent the wheel so that relative rotation between the wheel and the beam can occur. For cleaning the residue deposited in natural gas or oil heaters, a multiple-orifice jet head assembly is mounted on the beam. As the relative rotation between the heater and the beam occurs, a path of approximately eight inches, for example, is cleaned by an eight inch sheet of water ejected from the multiple-orifice jet head assembly. When this path is cleaned, the jet head assembly is moved along the beam so that an adjacent path around the heater wheel is cleaned. When such a relatively wide path is cleaned, the jet head assembly can be positioned along the beam without a great deal of accuracy whereby a visible overlap occurs to insure that no portion of the wheel is left uncleaned.

In cleaning regenerative air heater wheels which are used with the higher residue depositing fuels, such as coal, cleaning is accomplished with the application of higher-pressure water streams because these types of fuel create residues which adhere to the steel plates more tightly than the residues created by natural gas and oil. To remove the deposits resulting from such poorer quality fuels, a higher expenditure of energy per unit area on the residue must be made. This is accomplished by ejecting water from a jet head at a relatively higher pressure and by using a larger diameter jet nozzle. However, because a higher pressure and larger diameter jet nozzle is used, fewer jet nozzles must be utilized if one is to stay within the available horsepower and other capabilities of the ordinary pumping equipment currently used. By using higher water pressures, there is more energy available to dislodge the residue, and by using larger nozzles, a more cohesive stream of water which retains its energy over a greater distance is achieved; however, by decreasing the number of nozzles in the jet head assembly, the width of the path cleaned during each relative rotation between the wheel and the nozzle or nozzles is significantly reduced. For example, one nozzle might clean a path only a quarter of an inch wide.

With such a small cleaning path, it becomes more critical to carefully control the incremental distance which the jet head assembly is moved after each path is cleaned. Because the heater wheel is large, it takes a substantial time to clean each quarter-inch path; therefore, if improper incremental movement is permitted, the cleaning time for the entire wheel will become prohibitive. Although it is important not to improperly overlap adjacent cleaned areas when such a small path is cleaned for each revolution, the incremental distance must also be controlled so that no uncleaned paths remain.

With respect to the regenerative air heaters which are fired by the poorer quality fuels and thus require stronger cleaning pressures and smaller cleaning paths, and the concomitant precise spacing requirements, there is the need for an apparatus which can be precisely positioned to achieve the cleaning within an acceptable time period. With respect to this need, I am aware of three types of cleaning apparatus which purport to achieve this precise positioning. One of these includes a screw advance mechanism; another includes a winch driven by an electric motor; and the third system includes a roller chain and sprocket assembly which is advanced in response to an electronic timer.

In addition to the foregoing needs, there is the need for an apparatus which can be precisely moved in repeatable increments which are selectable from a range of lengths. For convenience and safety there is the need for the apparatus to be remotely controllable and to be powered from available plant air and electrical sources. The control must provide accurately timed periods which can be varied in duration so that the apparatus can be used with different types of regenerative air heaters. To further enhance the versatility of the apparatus, it should be portable and manually adjustable. Manual adjustability is desirable so the apparatus can be positioned to properly reach and clean the innermost and outermost portions of the air heater. The apparatus should also be capable of use with either high or low pressures, and it should be capable of bi-directional movement along a support member associated with the regenerative air heater wheel.

The present invention meets the aforementioned needs by providing a novel and improved fluid-jetting apparatus which is incrementally movable along a support member. The apparatus broadly comprises carriage means for mounting on the support member, actuator means for mounting on the support member, fluid ejection means associated with the carriage means, and drive means for operating the apparatus in a plurality of cycles wherein each cycle has one phase during which the carriage means is maintained stationary relative to the support member and the actuator means is moved relative to the support member and further wherein each cycle has another phase during which the actuator means is maintained stationary relative to the support member and the carriage means is moved relative to the support member.

The carriage means broadly includes a framework defining a channel for receiving the support member. The framework includes a side member which is movable between an open position in which the framework can be mounted on or dismounted from the support member and a closed position in which the framework is prevented from being mounted on or dismounted from the support member. This provides the apparatus with the feature of portability whereby it can be placed on and removed from different support members. The position of the carriage means on the support member can be manually adjusted.

The fluid ejection means broadly includes a nozzle and means for slidably and rotatably connecting the nozzle to the framework.

The drive means includes first brake means associated with the carriage means and second brake means associated with the actuator means. The drive means also includes adjustable spacer means for establishing an incremental distance the carriage means is movable along the support member during each of the cycles. The drive means still further includes movement means for effecting relative movement between the carriage means and the actuator means. The drive means also includes control means for controlling the operation of the first brake means, the second brake means and the movement means.

In one embodiment the control means includes first conduit means connected to the first and second brake means, second conduit means connected to the first and second brake means, first timer means, and second timer means which is responsive to the first timer means. The timer means are adjustable so that different operating periods can be selected. The control means also includes first valve means which is responsive to the second timer means and has a first port, a second port and a third port. The first valve means selectably communicates the first port with either the second port or the third port. The control means also includes second valve means for communicating the second port with the second conduit means and the third port with the first conduit means when the second valve means is operated in a first mode and for communicating the second port with the first conduit means and the third port with the second conduit means when the second valve means is operated in a second mode. The second valve means enables the carriage means to be moved in either direction along the support member. The control means can be located remotely from the carriage means.

Therefore, from the foregoing, it is a general object of the present invention to provide a novel and improved fluid-jetting apparatus incrementally movable along a support member. Other and further objects, features and advantages of the present invention will be readily apparent to those skilled in the art when the following description of the preferred embodiment is read in conjunction with the accompanying drawings.

FIG. 5 is a top plan view of the portion shown in FIG. 1.

FIG. 6 is a front elevational view of the control portion of the present invention.

FIGS. 7 and 8 schematically depict a preferred embodiment pneumatic circuit of the present invention and the operation thereof in each of the two phases of a cycle of the present invention moving in a first direction.

Figure 9:
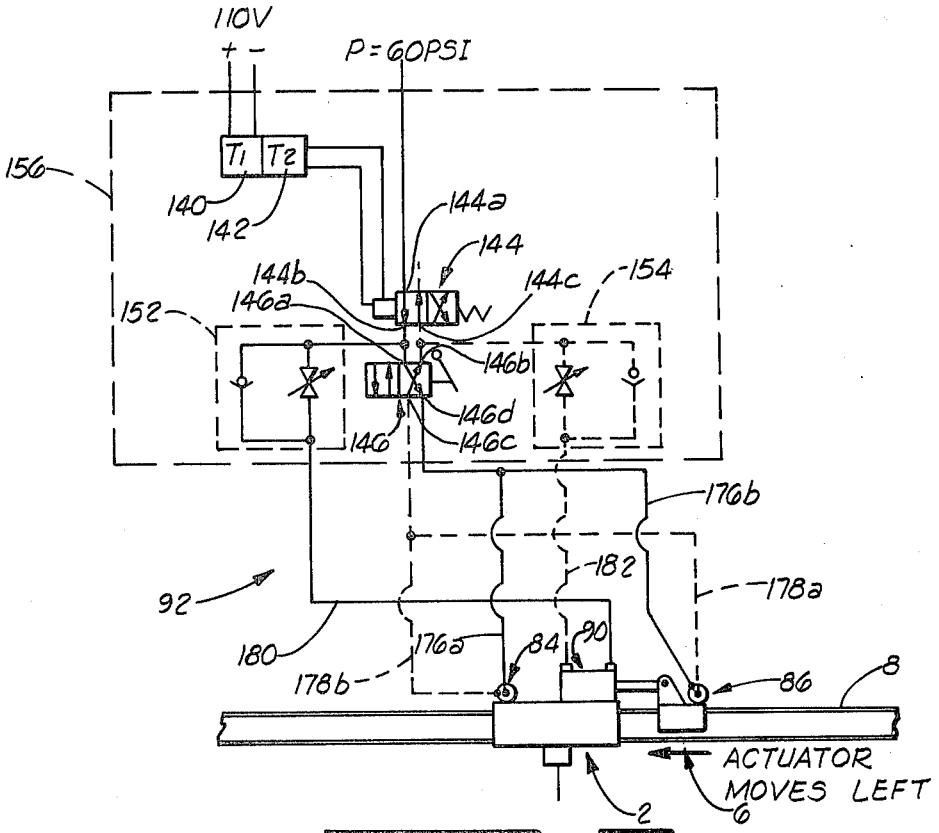
Figure 10:
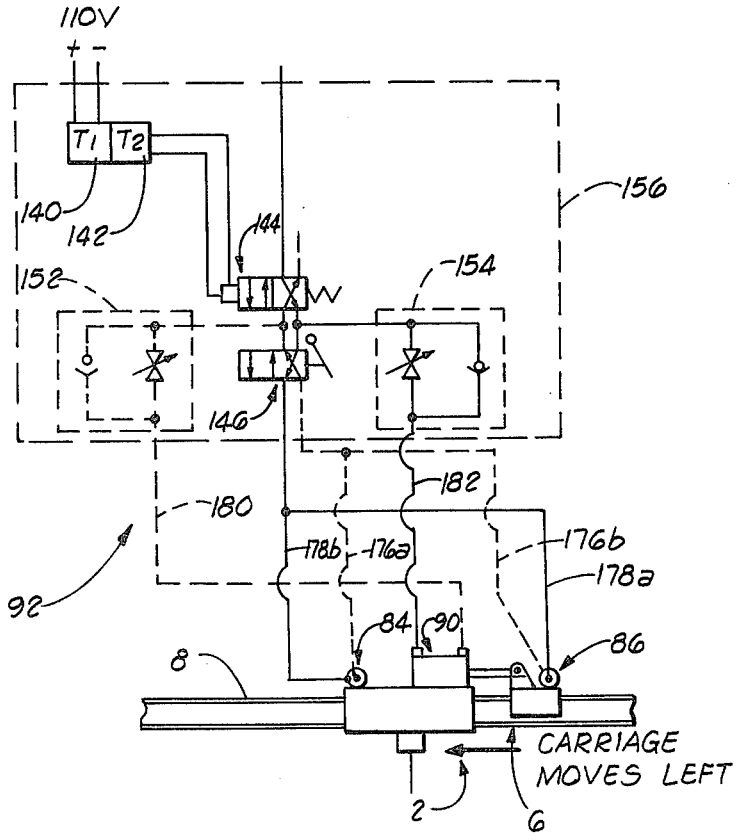

FIGS. 9 and 10 schematically depict the two phases of another cycle of the present invention moving in a second direction.

Figure 11:
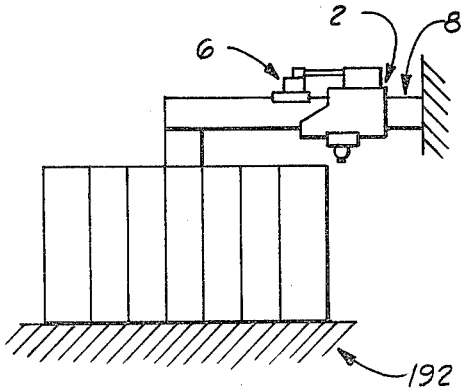

FIG. 11 is a schematic representation, not drawn to scale, of the present invention mounted on a support member retained above a regenerative air heater wheel.

With reference to the drawings an apparatus constructed in accordance with the preferred embodiment of the present invention will be described. The apparatus broadly includes a carriage means 2, a fluid ejection means 4, an actuator means 6, and a drive means for operating the apparatus in a plurality of cycles.

The carriage means 2 includes a framework defining a channel for receiving a support member 8. The support member 8 is any suitable element with which the present invention is associable, such as a 6-inch×6-inch or 2-inch×5-inch H-beam or I-beam as known to the art. In the drawings the support member 8 is illustrated as an I-beam having a top flange 10 and a bottom flange 12 connected by a central web 14. The top flange 10 has an outer surface 16 and inner surfaces **18*a*, 18*b*, and the bottom flange 12 has an outer surface 20 and inner surfaces 22*a*, 22*b*. It is to be noted that the words "top", "bottom", "outer" and "inner" are used with reference to the disposition of the support member 8** shown in the figure; however, these designations are not to be taken as limiting the possible orientations in which the present invention can be used.

The framework of the carriage means 2 includes a first side member 24 (see FIG. 2) oriented in the preferred embodiment so that it extends substantially parallel to the central web 14 of the support member 8; however, this preferred embodiment orientation is not to be taken as limiting other possible orientations which the first side member 24 might take relative to another type of support member or with respect to the specific support member 8 shown in the drawings. Rigidly connected by suitable means to the first side member 24 are a hinge plate 26 and a latch plate 28. In the preferred embodiment, the plates 26 and 28 are connected to the first side member 24 by the axles (not shown) of cylindrical rollers 30, 32, 34 and 36 forming the preferred embodiment of a roller means which is also a part of the carriage means 2. The axles are welded to the respective member or plates in the preferred embodiment. The rollers 30, 32 engage the surface 16 and the rollers 34, 36 engage the surface 20 when the carriage means is mounted on the support member 8.

The hinge plate 26 is also secured to the first side member 24 by means of a fluid ejection means mounting member 38 (see FIG. 3) connected therebetween. The member 38 has longitudinal edges 40, 42 and a dovetail configuration as viewed in FIG. 3 whereby the longitudinal edges 40, 42 are beveled or feathered.

The framework of the carriage means 2 also includes a second side member 44 (see FIG. 1) hinged to the hinge plate 26 by a hinge 46. Suitably connected, such as by welding, to the second side member 44 are two latch pieces 48, 50 which are securable by suitable means, such as bolts, to the latch plate 28 when the second side member 44 is in a closed position whereby said framework is prevented from being mounted on or dismounted from the support member 8. The second side member 44 is movable between this closed position and an open position in which the framework can be mounted on or dismounted from the support member 8. To facilitate the mounting or dismounting of the carriage means 2 on the support member 8, it is to be noted that in the preferred embodiment the rollers 30 and 32 are parallel to the rollers 34 and 36 and spaced therefrom a distance substantially equal to the distance between the outer surface 16 of the top flange 10 and the outer surface 20 of the bottom flange 12 and that the hinge plates 26 and the latch plate 28 are connected to the respective ones thereof so that their facing edges are spaced no closer than the distance between the outer surfaces 16 and 20.

The fluid ejection means 4 is associated with the carriage means 2 as shown in the drawings. The fluid ejection means 4 includes a jet head assembly 52 including a plurality of nozzles 54, 56, 58, 60; however, one or any other suitable number of nozzles can be used as known in the art. The jet head assembly 52, more generally, is of a suitable type known to the art.

The jet head assembly 52 also includes means for connecting with conduit means from a high-pressure water, or other cleaning fluid, source. In the preferred embodiment the connecting means is shown to include threaded collars 62, 64. In the figures these threaded collars are shown having hoses 66, 68, respectively, connected thereto. The hoses 66, 68 form a conduit means of the preferred embodiment. This conduit means may more generally be any suitable fluid conducting means such as, for example, a rigid pipe with movable swing joints or the high strength flexible hoses exemplified by hoses 66, 68.

The fluid ejection means 4 also includes means for slidably and rotatably connecting the nozzles 54, 56, 58, 60 (and more generally the jet head assembly 52) to the framework of the carriage means 2. This connecting means of the preferred embodiment is shown to include a slide piece 70 having an interior cavity complementally shaped for receiving the bottom plate 38 as illustrated in the drawings. The slide piece 70 is slidable along the length of the bottom plate 38 so that the jet head assembly 52 can be manually moved to reach the extreme inner and outer portions of the regenerative air heater contemplated to be cleaned by the present invention. The slide piece 70 has suitable stop means associated therewith for holding the slide piece 70 in a selected position along the bottom plate 38. For example, the stop means can include a bolt which passes through a threaded hole in the slide piece 70 and frictionally engages the bottom plate 38 when it is tightened thereagainst.

Figure 3:
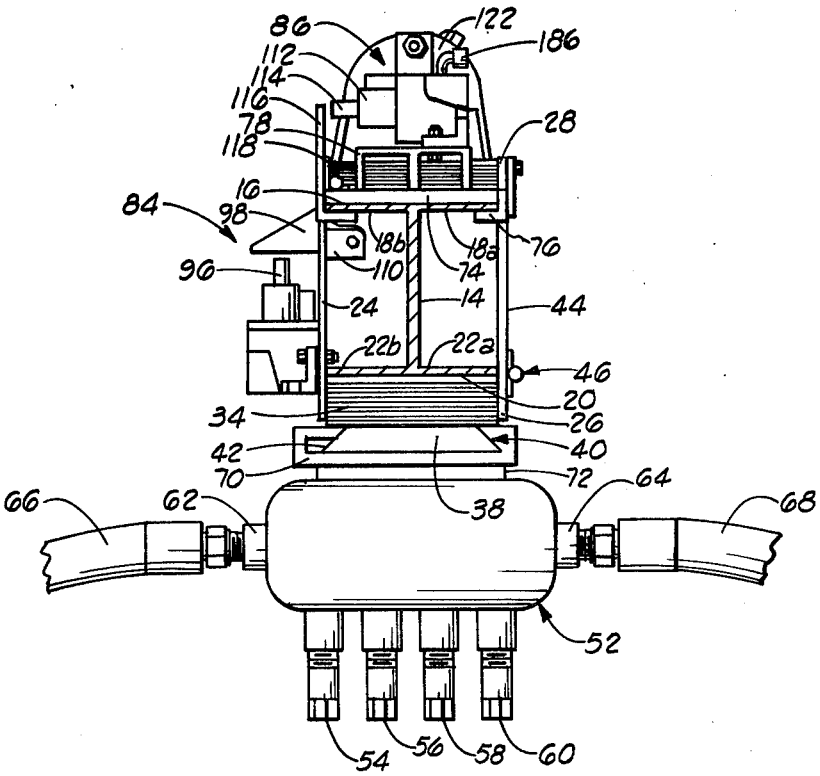
FIG. 3 is a first end elevational view of the portion shown in FIG. 1 as taken along line 3—3.

The connecting means also includes rotary coupling means 72 for enabling the jet head assembly 52 to swivel or pivot relative to the slide piece 70. The rotary coupling means 72 enables the jet head assembly 52 to have a variable width cleaning path when multiple nozzles are used. For example, when the jet head assembly 52 is positioned as shown in FIG. 3, the minimum width of the cleaning path is defined. However, if the jet head assembly 52 were pivoted, the width of the cleaning path would be increased. If the jet head assembly 52 were pivoted 90° to that position shown in FIG. 3, the maximum width of the cleaning path would be defined.

The actuator means 6 is shown in the figures to be slidingly disposed on the support member 8 so that it can traverse the support member 8 under a driving force provided by the drive means. The actuator means 6 includes a base 74 (see FIGS. 1, 3 and 5) which extends across and rides on the outer surface 16 of the top flange 10 in the preferred embodiment. The actuator means 6 also includes a guide member 76 connected to or integrally formed with the base 74. In the preferred embodiment shown in the drawings, the guide member 76 is an L-shaped element attached to the base 74 to form a channel for receiving a first edge of the top flange 10 whereby the inner face of one of the legs of the L-shaped element faces the inner surface 18*a*.

Mounted on the base 74 is a mounting platform 78 on which a portion of the drive means is mounted. Also attached to the base 74 are a first retaining member 80 and a second retaining member 82 for coupling with other portions of the drive means as will be further described hereinbelow.

The drive means broadly includes first brake means 84 (see FIGS. 2, 3 and 4) associated with the carriage means 2, second brake means 86 (see FIGS. 1, 2 and 3) associated with the actuator means 6, adjustable spacer means 88 (see FIG. 1) for establishing an incremental distance which the carriage means 2 is movable along the support member 8 during cycles of operation of the present invention, movement means 90 (see FIG. 1) for effecting relative movement between the carriage means 2 and the actuator means 6, and control means 92 (see FIGS. 6–10) for controlling the operation of the first brake means 84, the second brake means 86, and the movement means 90.

The first brake means 84 is fluid-actuated and in the preferred embodiment includes an air cylinder mechanism 94 suitably attached to the first side member 24 of the carriage means 2. In the preferred embodiment this attachment is by means of suitable nuts and bolts. The air cylinder mechanism 94 includes a suitable piston responsive to air. This piston can be, for example, a single-acting, spring-return piston or a double-acting piston. Connected to the piston is a piston rod 96.

Figure 2:
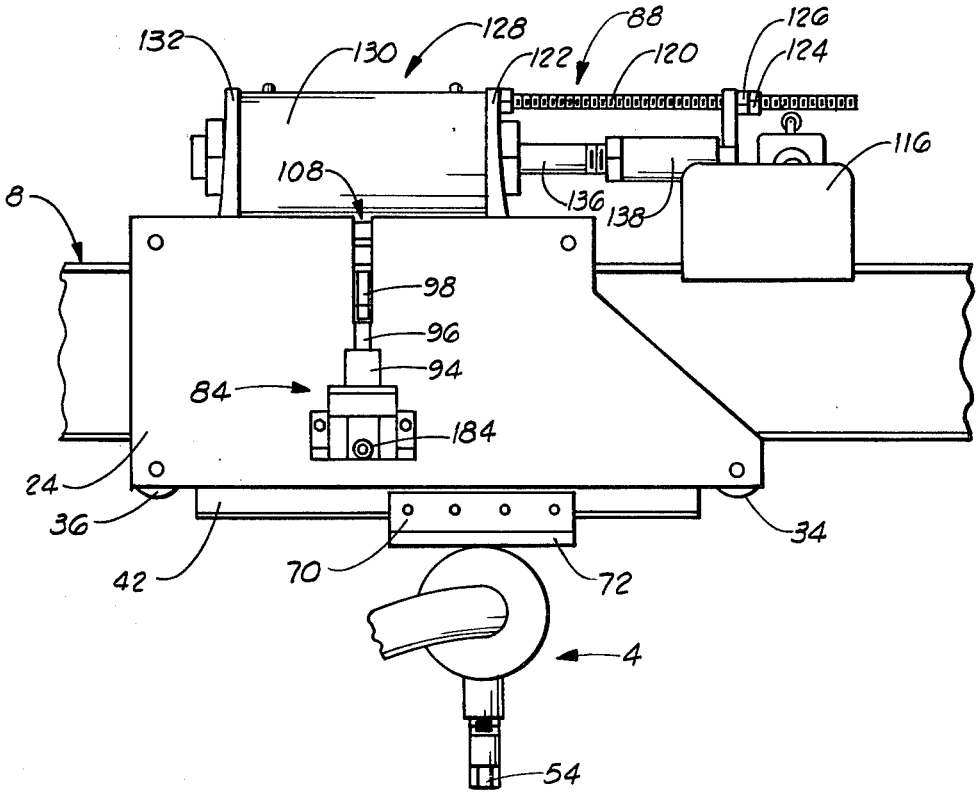
FIG. 2 is a second side elevational view of the portion shown in FIG. 1.
Figure 4:
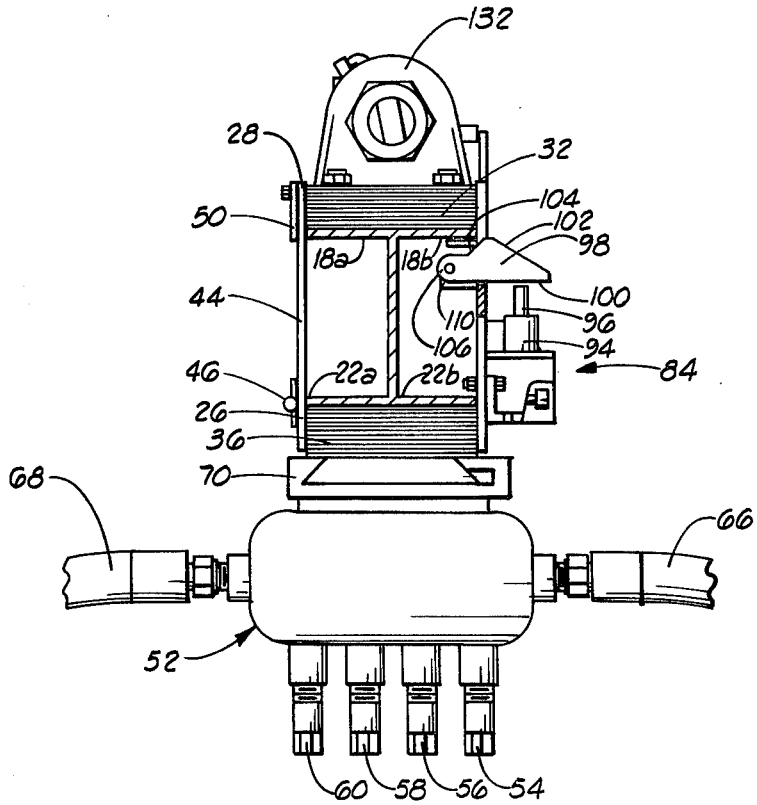
FIG. 4 is a second end elevational view of the portion shown in FIG. 1, showing a portion thereof in section, as taken along line 4—4 shown therein.
Figure 3:
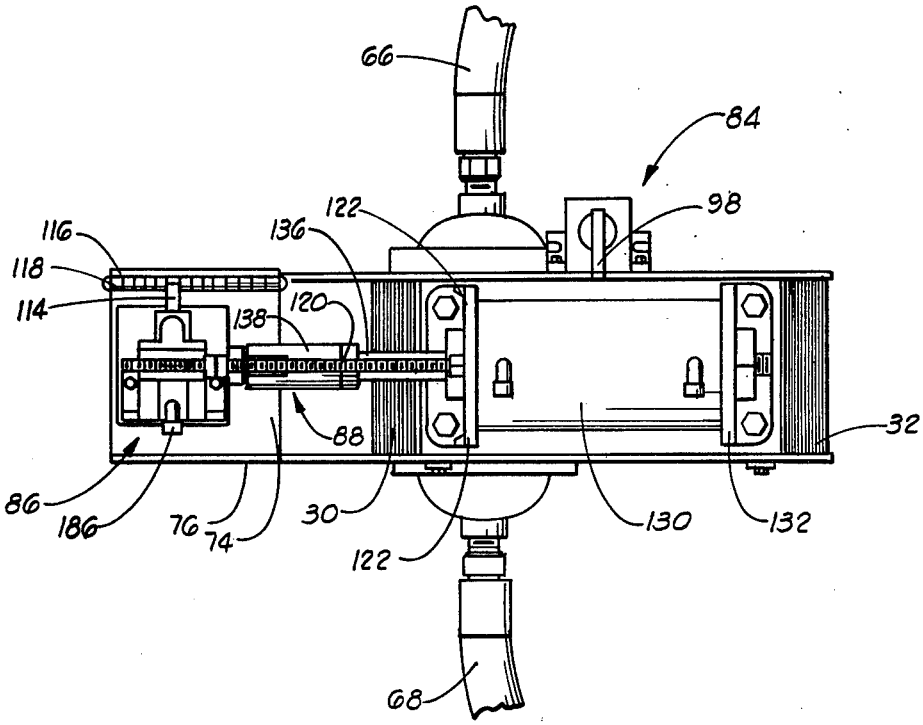
Figure 4:
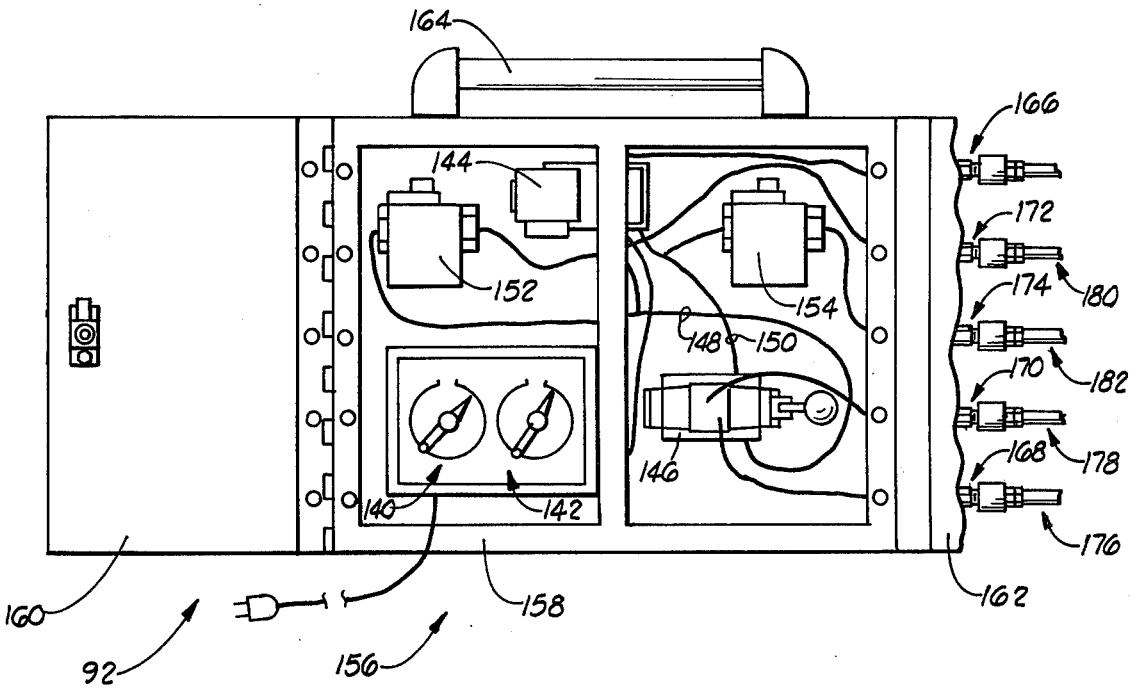
Figure 1:
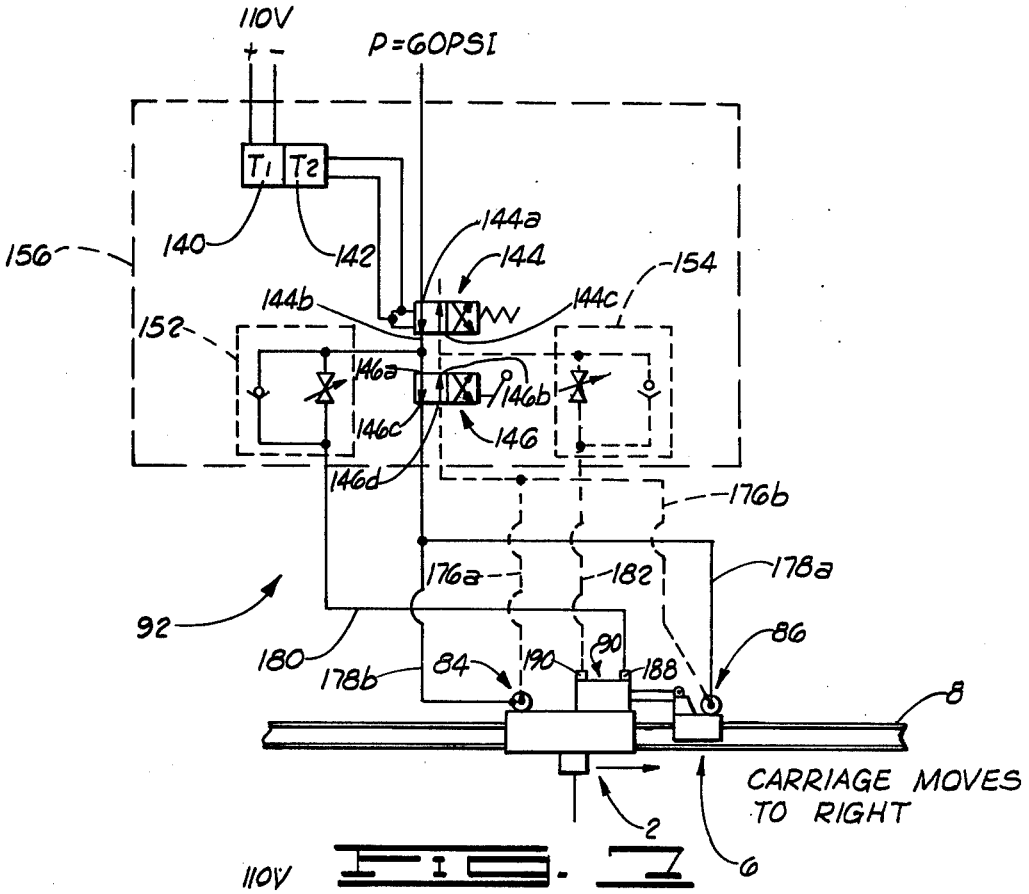
Figure 2:
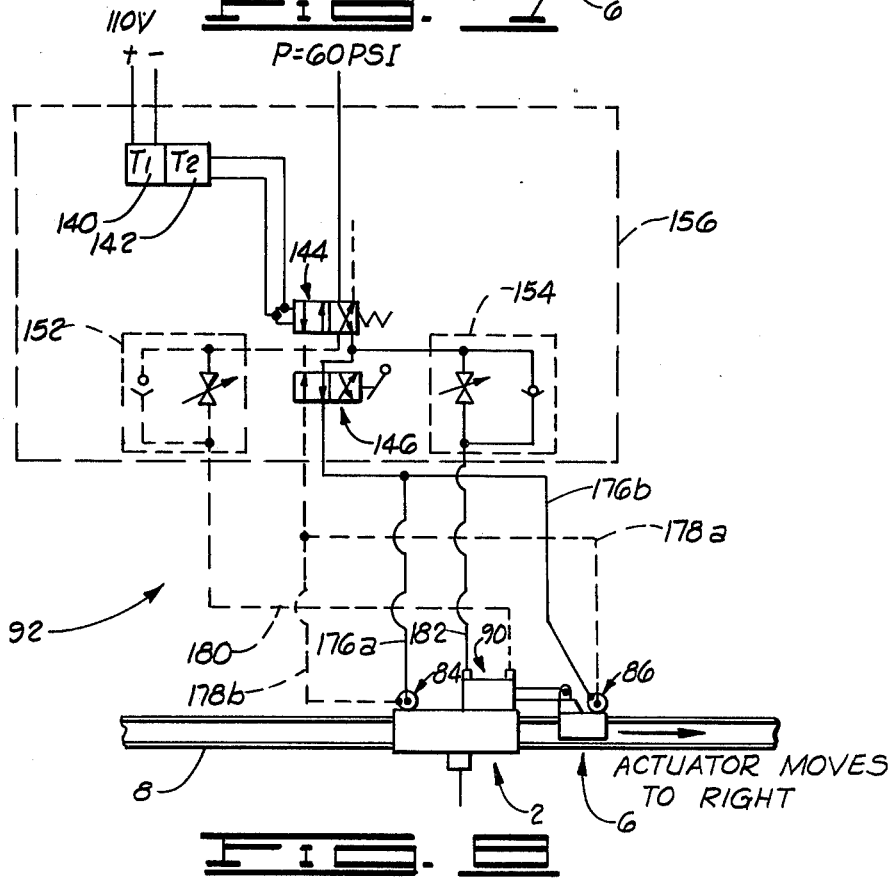

The first brake means 84 also includes first mechanical grip means 98 for engaging the support member 8 when urged thereagainst by the piston rod 96. In the preferred embodiment the mechanical grip means 98 includes a brake element having a portion approximating a triangular shape as defined by a base edge 100, a first leg edge 102 and a second leg edge 104. The second leg edge 104 has a protuberance 106 by which the brake element is pivotally connected to the first side member 24. As best shown in FIGS. 2 and 4, the brake element of the mechanical grip means 98 extends through a slot or opening 108 defined in the side member 24 whereby the protuberance 106 lies adjacent and is pivotally connected to a flange 110 extending inwardly of the side member 24 so that the flange 110 is disposed between the surfaces 18*b* and 22*b* when the carriage means 2 is mounted on the support member 8. In this configuration the second leg edge 104 engages a second edge of the top flange 10 when the piston rod 96 is forced against the base edge 100 of the mechanical grip means 98.

The second brake means 86 is also fluid-actuated, specifically air-actuated in the preferred embodiment. The second brake means 86 of the preferred embodiment includes a second air cylinder mechanism 112 of a type similar to the air cylinder mechanism 94. The air cylinder mechanism 112 has a piston (not shown) to which a piston rod 114 is connected. The air cylinder mechanism 112 is suitably mounted on the mounting platform 78 of the actuator means 6. This mounting is by any suitable means, such as by nuts and bolts as shown in the drawings.

The second brake means 86 also includes a second mechanical grip means 116 comprising an L-shaped (when examined in an end view) brake element pivotally mounted to the base 74 by a hinge means 118 or other suitable connector means. The mechanical grip means 116 operates in response to the piston rod 114 engaging the upper end of the longer leg of the L-shaped element, thereby pivoting the element so that the shorter leg thereof engages the support member 8 as is apparent from an examination of the drawings.

The adjustable spacer means 88 includes a rigid member and means for connecting the rigid member between the carriage means 2 and the actuator means 6 so that the maximum distance the carriage means 2 can be spaced from the actuator means 6 along the support member 8 is adjustable. In the preferred embodiment the rigid member includes a threaded rod 120 fixed to a retaining plate 122 rigidly connected to the carriage means 2. The threaded rod 120 passes through a hole defined in the first retaining member 80 of the actuator means 6. The hole of the first retaining member 80 has a diameter which is greater than the outermost diameter of the rod 120 so that the actuator means 6 can move relative to the rod 120.

The means for connecting the rigid member between the carriage means 2 and the actuator means 6 includes in the preferred embodiment two nuts 124, 126 which are threaded on the portion of the rod 120 extending beyond the first retaining member 80. It will be readily understood that by adjusting the location of the nuts 124, 126 along the rod 120, the maximum distance which the actuator means 6 can be spaced from the carriage means 2 by the movement means 90 will likewise be adjusted.

The movement means 90 includes a fluid-actuated piston means 128 slidably mounted on the carriage means 2. The fluid-actuated piston means 128 of the preferred embodiment includes a four-inch air cylinder 130 secured to the carriage means 2 by the retaining plate 122 and another retaining plate 132 which is also rigidly connected to the carriage means 2. The fluid-actuated piston means 128 also includes a double-acting piston 134 (shown in phantom in FIG. 1). Connected to the piston 134 is a piston rod 136 which is also connected to the actuator means 6. The connection with the actuator means 6 is, in the preferred embodiment, made by a clevis 138 which is connected by suitable means to the second retaining member 82. With this connection between the piston rod 136 and the actuator means 6, it is apparent that the carriage means 2 and the actuator means 6 can be moved relative to each other in response to movement of the piston 134. The maximum distance the carriage means 2 and the actuator means 6 can be separated is limited by the setting of the adjustable spacer means 88 as mentioned hereinabove.

The control means 92 controls the operation of the first brake means 84, the second brake means 86 and the movement means 90 as mentioned hereinabove. With reference to the preferred embodiment, the control means specifically controls the application of a driving fluid to the cylinders of these three elements. In the preferred embodiment this driving fluid is compressed air supplied from a suitable source, such as the plant compressed air supply where the present invention is to be utilized. With reference primarily to FIG. 6 a first preferred embodiment of the control means 92 will be described.

The control means 92 includes a first timer means 140 and a second timer means 142 which is responsive to the first timer means 140. The two timer means of the preferred embodiment are powered by a common 110-volt ac power supply as would be found in a plant in which the present invention is contemplated to be used. The timer means are automatically resettable types as are known to the art. For example, in the preferred embodiment the two timer means are the Dual-Trol timer of Meylan Stopwatch Corporation. The first timer means 140 can be set to time a period up to sixty minutes, for example, or other suitable period to define the dwell period, or cleaning period, during which the carriage means 2 remains at a single location along the support member 8. The second timer means 142 is settable up to a maximum of one minute, for example, or other suitable time period which is sufficient to allow the piston rod 136 to be extended or retracted within the constraints of the setting of the adjustable spacer means 88. Once the time period defined by the first timer means 140 expires, it activates the second timer means 142 to commence its predetermined time period and to actuate a first valve means 144.

The first valve means 144 is a solenoid valve of a suitable type known in the art for the preferred embodiment of the present invention. The first valve means 144 (see FIG. 7) has a first port 144*a* which is connectable by suitable means to the source of compressed air used in the preferred embodiment. The first valve means 144 also has a second port 144*b* and a third port 144*c* which are connectible to the first port depending upon the positioning of the valve member of the first valve means 144. Depending upon the energization of the solenoid of the first valve means 144, either the second port 144*b* or the third port 144*c* is selectably communicated with the first port 144*a*.

The control means 92 also includes a second valve means 146 having a first port 146*a* in fluid communication with the second port 144*b* of the first valve means 144 and also having a second port 146*b* in fluid communication with the third port 144*c* of the first valve means 144. As shown in FIG. 6, these fluid communications are made in the preferred embodiment by means of suitable connector lines 148 and 150, respectively. The second valve means 146 also has a third port 146*c* and a fourth port 146*d* (see FIG. 7).

The second valve means 146 is a manual valve which is used by an operator of the present invention to control the direction of progression of the carriage means 2 along the support member 8. That is, when the second valve means 146 is moved into a first position, the carriage means moves in one direction along the support member 8, and when the second valve means 146 is placed in its second position, the carriage means 2 moves in the opposite direction along the support member 8. In the preferred embodiment each of the first and second valve means 144, 146 is a two-position, four-way valve as known to the art.

The control means 92 also includes a third valve means 152 and a fourth valve means 154, each of which is of a type known to the art and each of which is used for the purpose of introducing time delays in the pneumatic system of the preferred embodiment as will be more fully described hereinbelow. The time delay occurs when the fluid flows from the first valve means 144 to the movement means 90 through either of the valve means 152, 154; however, no time delay is introduced when a reverse flow from the movement means 90 through either of the valve means 152, 154 occurs. This time delay is achieved by the respective valve member of one of the valve means 152, 154 preventing a portion of the fluid passing from the second port **144*b* or the third port 144*c* from actuating the movement means 90 prior to the time another portion of the fluid actuates either the first brake means or the second brake means. The third valve means 152 communicates the second port 144*b* of the first valve means 144 with the movement means 90 and the fourth valve means 154 communicates the third port 144*c* of the first valve means 144 with the movement means 90**, as will be more particularly described hereinbelow.

Each of the aforementioned elements 140–154 is contained within a portable housing 156 as shown in FIG. 6. The housing has an interior compartment in which these elements are disposed, and the interior compartment may be fully closed by means of doors 160, 162. The housing also has a handle 164 connected to the case 158 for enhancing the portability. Also disposed in the case 158 are a plurality of connectors. In the preferred embodiment shown in FIG. 6, there are five connectors 166, 168, 170, 172, 174 for coupling with the various air lines utilized in the present invention. For example, the connector 166 receives the air line from the compressed air source. The connectors 168–174 couple with air lines extending to the portion of the apparatus mounted on the support member 8.

The air lines connected to the connectors 168, 170, 172, 174 form a part of, respectively, a first conduit means 176 connected between the second valve means 146 and the first brake means 84, a second conduit means 178 connected between the second valve means 146 and the second brake means 86, a third conduit means 180 connected between the first valve means 144 and one side of the fluid-actuated piston means 128, and a fourth conduit means 182 connected between the first valve means 144 and a second side of the fluid-actuated piston means 128.

The first conduit means 176 extends from the fourth port **146*d* of the second valve means 146 to the air cylinder mechanism 94 and connects therewith at suitable connector means 184. In the preferred embodiment shown in FIGS. 1–6 the air cylinder mechanism 94 includes a single-acting, spring-return piston; therefore, the first conduit means 176 is connected to the air cylinder mechanism 94** so that air is provided to the side of the piston which is in opposition to the force provided by the spring therein.

The second conduit means 178 extends between the third port **146*c* of the second valve means 146 and the side of the piston in the air cylinder mechanism 112 opposite the side against which the spring of the preferred embodiment air cylinder mechanism 112 acts. The second conduit means 178 connects thereto at a suitable connector means 186**.

Figure 1:
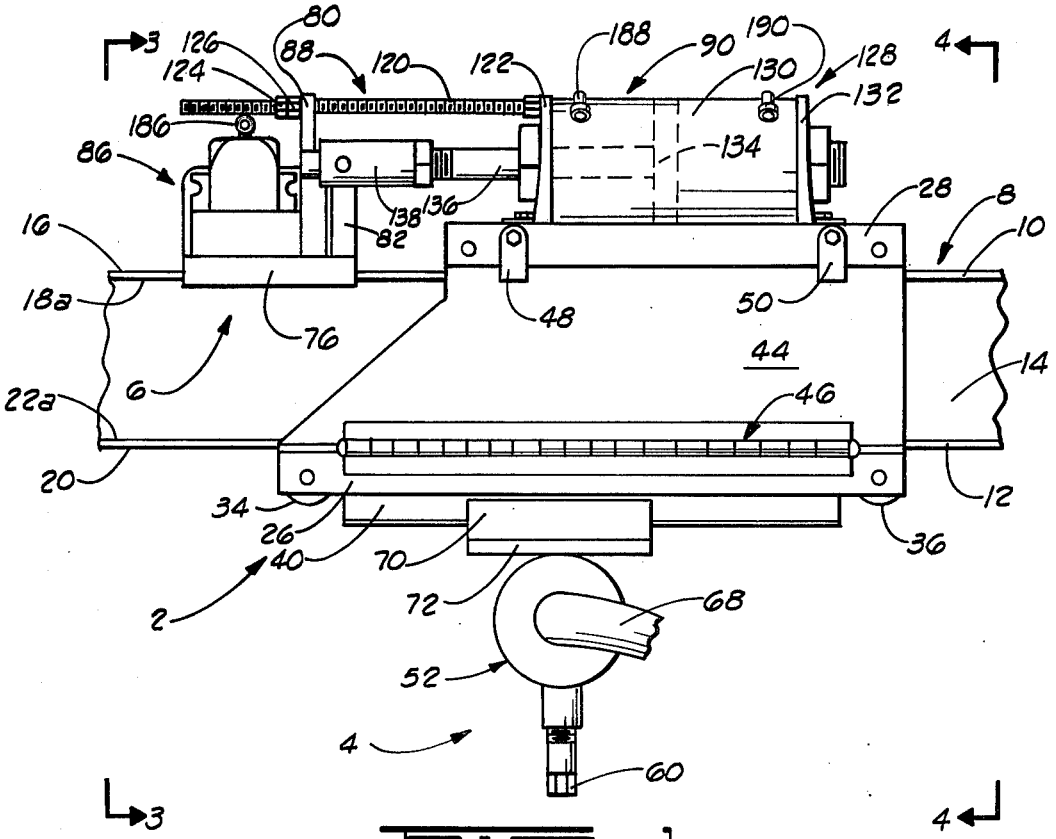
FIG. 1 is a first side elevational view of the support member-mountable portion of the preferred embodiment of the present invention.

The third conduit means 180 is connected to the fluid-actuated piston means 128 at a suitable connector means 188 shown in FIG. 1 so that when compressed air is provided through the third conduit means 180 into the cylinder 130, the piston 134 is moved to the right relative to the cylinder 130 as viewed in FIG. 1. The fourth conduit means 182 is connected to the cylinder 130 at a suitable connector means 190 so that when compressed air is provided through the fourth conduit means 182 into the cylinder 130, a force acting against the right side of the piston 134 as viewed in FIG. 1 is exerted.

The third valve means 152 is disposed in the third conduit means 180, and the fourth valve means 154 is disposed in the fourth conduit means 182. Each of the valve means 152, 154 delays the delivery of compressed air to the fluid-actuated piston means 128 until the elapse of a time which is sufficient to allow the appropriate one of the first or second brake means to be set in response to the conduction of compressed air through either the first conduit means 176 or the second conduit means 178.

With reference to FIGS. 7–10, the second preferred embodiment of the control means 92 will be described. Those elements in FIGS. 7–10 bearing like reference numerals to elements shown in FIGS. 1–6 indicate that the elements are the same. As will be noted, the distinction between the two embodiments lies in the branches of the first and second conduit means 176, 178.

As will be noted, the first conduit means 176 illustrated in FIGS. 7–10 includes not only a first branch **176*a* extending to the first brake means 84, but also a second branch 176*b* extending to the second brake means 86. This construction is used when the air cylinder mechanisms of the first and second brake means include double-acting pistons. Similarly, the second conduit means 178 in the FIGS. 7–10 embodiment has a first branch 178*a* exending to the second brake means 86 and a second branch 178*b* extending to the first brake means 84**.

With reference to the pneumatic connections shown in FIGS. 7–10, the operation of the present invention will be described. It is to be noted that for the first preferred embodiment wherein the air cylinder mechanism 94 and the air cylinder mechanism 112 are single-acting, spring-return mechanisms, the operation is similar except that the spring-return action replaces the comparable pneumatic action which will be described with reference to FIGS. 7–10.

It is to be noted that the drive means of the present invention operates the apparatus in a plurality of cycles. Each cycle has one phase during which the carriage means 2 is maintained stationary relative to the support member 8 and the actuator means 6 is moved relative to the support member 8 and the carriage means 2. Each cycle also has another phase during which the actuator means 6 is maintained stationary relative to the support member 8 and the carriage means 2 is moved relative to the support member 8 and the actuator means 6.

It is also to be noted that the second valve means 146 is operable in either a first mode or a second mode to determine in which direction the carriage means 2 and actuator means 6 are moved relative to the support member 8 during the cycles. When the second valve means 146 is operated in the first mode, the second port 144*b* of the first valve means 144 is communicated with the second conduit means 178 and the third port **144*c* of the first valve means 144 is communicated with the first conduit means 176. When the second valve means 146 is operated in the second mode, the second port 144*b* of the first valve means 144 is communicated with the first conduit means 176 and the third port 144*c* of the first valve means 144 is communicated with the second conduit means 178. With the apparatus oriented on the support member 8 as shown in FIGS. 7–10, the first mode causes the apparatus to move to the right along the support member 8 as illustrated in FIGS. 7 and 8, and the second mode causes the apparatus to move to the left along the support member 8 as illustrated in FIGS. 9 and 10**.

When the apparatus is operating in the first mode, the first phase of a cycle of operation causes the carriage means 2 to move to the right towards the stationary actuator means 6 as shown in FIG. 7. This occurs when the first timer means 140 expires, thereby activating the second timer means 142. Activation of the second timer means 142 causes the solenoid of the first valve means 144 to place the valve member thereof ih the position illustrated in FIG. 7 whereby the compressed air is provided to the second conduit means 178 for setting the second brake means 86 on the actuator means 6 and for releasing the first brake means 84 on the carriage means 2 and whereby the exhaust air from the opposite sides of the brake cylinders is released through the first conduit means 176. After a delay period through the third valve means 152, the compressed air is provided via the third conduit means 180 to the fluid-actuated piston means 128 as illustrated in FIG. 7 to actuate the piston rod 136 whereby it is retracted into the cylinder 130 thereby moving the carriage means 2 toward the actuator means 6. The exhaust air of the piston means 128 is released via the fourth conduit means 182. The compressed air is maintained on the piston 134 in this manner until the time period of the second timer means 142 expires thereby causing the first valve means 144 to assume the position illustrated in FIG. 8.

With the pneumatic circuit as shown in FIG. 8, the second phase of the cycle of operation is entered whereby the first brake means 84 on the carriage means 2 is set and the second brake means 86 on the actuator means 6 is released and further whereby the compressed air is provided to the opposite side of the piston 134 of the fluid-actuated piston means 128 thereby causing the piston rod 136 thereof to be extended to force the actuator means 6 to move away from the stationary carriage means 2. The actuator means 6 is caused to move away from the carriage means 2 until the limit established by the adjustable spacer means 88 is reached. Once this limit is reached, the apparatus remains in the manner illustrated in FIG. 8 until the first timer means 140 period expires and the first phase of a new cycle of operation commences in a manner identical to that shown in FIG. 7.

The operation of each phase of a cycle during which the second valve means 146 is operated in the second mode is illustrated in FIGS. 9 and 10 and is seen to operate the apparatus so that movement is to the left as viewed in the figures. During the first phase of a cycle in the second mode, it is apparent from an examination of FIG. 9 that the carriage means 2 is maintained stationary relative to the support member 8 and the actuator means 6 is moved to the left toward the stationary carriage means 2. Upon the expiration of the second timer means 142 period, the second phase of the cycle in the second mode is entered as illustrated in FIG. 10. During this phase, the actuator means 6 is maintained stationary relative to the support member 8 and the carriage means 2 is moved to the left by an amount again controlled by the setting of the adjustable spacer means 88.

FIG. 11 schematically illustrates the carriage means 2 and the actuator means 6 mounted on the support member 8 which is retained in a fixed position above a regenerative air heater wheel 192. This schematically illustrates one contemplated use of the present invention in that it may be moved left or right along the support member 8 to clean circular paths around the wheel 184 as the wheel rotates beneath the support member 8. It is, of course, contemplated that the present invention can be used in other applications.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A fluid-jetting apparatus incrementally movable along a support member, comprising:

carriage means for mounting on the support member, said carriage means including:

a framework defining a channel for receiving the support member, said framework comprising:

a side member movable between an open position in which said framework can be mounted on or dismounted from the support member and a closed position in which said framework is prevented from being mounted on or dismounted from the support member; and a roller for engaging a surface of the support member when said framework is mounted thereon;

actuator means for mounting on the support member;

fluid ejection means associated with said carriage means, said fluid ejection means including:

a nozzle; and means for slidably and rotatably connecting said nozzle to said framework;

drive means for operating said apparatus in a plurality of cycles, each cycle having one phase during which said carriage means is maintained stationary relative to the support member and said actuator member is moved relative to the support member and each cycle having another phase during which said actuator member is maintained stationary relative to the support member and said carriage means is moved relative to the support member, said drive means including:

first brake means associated with said carriage means;

second brake means associated with said actuator means;

adjustable spacer means for establishing an incremental distance said carriage means is movable along the support member during each of said cycles;

movement means for effecting relative movement between said carriage means and said actuator means; and control means for controlling the operation of said first brake means, said second brake means, and said movement means.

2. An apparatus as described in claim 1, wherein said control means includes:

first conduit means connected to said first and second brake means;

second conduit means connected to said first and second brake means;

first timer means;

second timer means, responsive to said first timer means;

first valve means, responsive to said second timer means and having a first port, a second port and a third port, for selectably communicating said first port with either said second port or said third port; and second valve means, operable in either a first mode or a second mode, for communicating said second port with said second conduit means, and said third port with said first conduit means, when said second valve means is operated in said first mode and for communicating said second port with said first conduit means, and said third port with said second conduit means, when said second valve means is operated in said second mode.

3. An apparatus as described in claim 2, wherein said control means further includes:

third valve means for communicating said second port with said movement means; and fourth valve means for communicating said third port with said movement means.

4. An apparatus as described in claim 3, wherein:

said third valve means includes means for preventing a portion of a fluid passing from said second port from actuating said movement means prior to the time another portion of the fluid actuates either said first brake means or said second brake means when said first port communicates with said second port; and said fourth valve means includes means for preventing a portion of the fluid passing from said third port from actuating said movement means prior to the time another portion of the fluid actuates either said first brake means or said second brake means when said first port communicates with said third port.

5. An apparatus as described in claim 4, wherein said first and second timer means and said first, second, third and fourth valve means are remote from said carriage means.

6. A fluid-jetting apparatus incrementally movable along a support member, comprising:

carriage means for traversing the support member;

actuator means for traversing the support member;

fluid ejection means associated with said carriage means; and drive means for operating said apparatus in a plurality of cycles, each cycle having one phase during which said carriage means is maintained stationary relative to the support member and said actuator member is moved relative to the support member and each cycle having another phase during which said actuator member is maintained stationary relative to the support member and said carriage means is moved relative to the support member, said drive means including:

first fluid-actuated brake means associated with said carriage means;

second fluid-actuated brake means associated with said actuator means;

adjustable spacer means for establishing an incremental distance said carriage means is movable along the support member;

fluid-actuated piston means mounted on said carriage means, having a piston rod connected to said actuator means; and control means for controlling the application of a fluid to said first brake means, said second brake means, and said piston means.

7. An apparatus as described in claim 6, wherein said adjustable spacer means includes:

a rigid member; and means for connecting said rigid member between said carriage means and said actuator member so that the maximum distance said carriage means can be spaced from said actuator means along the support member is adjustable.

8. An apparatus as described in claim 7, wherein said control means includes:

first conduit means connected to said first and second brake means;

second conduit means connected to said first and second brake means;

first timer means for defining a first time period during which said carriage means is stationary relative to the support member;

second timer means, responsive to said first timer means, for defining a second time period during which said piston means is controllable to effect relative movement between said carriage means and said actuator means;

first valve means, responsive to said second timer means and having a first port, a second port and a third port, for selectably communicating said first port with either said second port or said third port; and second valve means, operable in either a first mode or a second mode, for communicating said second port with said second conduit means, and said third port with said first conduit means, when said second valve means is operated in said first mode and for communicating said second port with said first conduit means, and said third port with said second conduit means, when said second valve means is operated in said second mode.

9. An apparatus as described in claim 8, wherein said control means further includes:

third valve means for communicating said second port with said piston means; and fourth valve means for communicating said third port with said piston means.

10. An apparatus as described in claim 9, wherein said apparatus further comprirses a housing, spaced from said carriage means, having said first and second timer means and said first, second, third and fourth valve means disposed therein.

11. An apparatus as described in claim 10, wherein said first port is connectable to a source of pressurized air.

12. An apparatus as described in claim 6, wherein said control means includes:

first conduit means connected to said first and second brake means;

second conduit means connected to said first and second brake means;

first timer means for defining a first time period during which said carriage means is stationary relative to the support member;

second timer means, responsive to said first timer means, for defining a second time period during which said piston means is controllable to effect relative movement between said carriage means and said actuator means;

first valve means, responsive to said second timer means and having a first port, a second port and a third port, for selectably communicating said first port with either said second port or said third port; and second valve means, operable in either a first mode or a second mode, for communicating said second port with said second conduit means, and said third port with said first conduit means, when said second valve means is operated in said first mode and for communicating said second port with said first conduit means, and said third port with said second conduit means, when said second valve means is operated in said second mode.

13. An apparatus as described in claim 12, wherein said control means further includes:

third valve means for communicating said second port with said piston means; and fourth valve means for communicating said third port with said piston means.

14. An apparatus as described in claim 13, wherein said apparatus further comprises a housing, spaced from said carriage means, having said first and second timer means and said first, second, third and fourth valve means disposed therein.

15. An apparatus as described in claim 14, wherein said first port is connectable to a source of pressurized air.

* * * * *